US006336734B1

(12) United States Patent
Arumugasaamy

(10) Patent No.: US 6,336,734 B1
(45) Date of Patent: Jan. 8, 2002

(54) LUMINAIRE LENS ASSEMBLY

(75) Inventor: Panchadasaram Arumugasaamy, Granville, OH (US)

(73) Assignee: NSI Enterprises, Inc., Newark, OH (US)

( * ) Notice: Subject to any disclaimer, the term of this patent is extended or adjusted under 35 U.S.C. 154(b) by 0 days.

(21) Appl. No.: 09/515,114

(22) Filed: Feb. 29, 2000

(51) Int. Cl.[7] ..... F21V 7/00
(52) U.S. Cl. ..... 362/309; 362/308; 362/339
(58) Field of Search ..... 362/326, 327, 362/325, 329, 336, 337, 335, 339, 332, 351, 308, 309

(56) References Cited

U.S. PATENT DOCUMENTS 3,329,812 A * 7/1967 Harling ..... 362/223
3,330,951 A * 7/1967 Neal ..... 362/309
3,705,303 A * 12/1972 Willis, Jr. ..... 362/308

* cited by examiner

*Primary Examiner*—Alan Cariaso
*Assistant Examiner*—Hargobind S. Sawhney

(57) ABSTRACT

A luminaire lens assembly having a top lens including an external reflecting area and a bottom lens with an external refracting area and an internal refracting area, wherein the internal refracting area has at least three concentric prismatic areas, a first concentric prismatic area having a first defined number of prisms, a second concentric prismatic area disposed directly adjacent the first concentric area having a second defined number of prisms at least 1.5 times as great as the first defined number of prisms, and a third concentric prismatic area disposed directly adjacent the second concentric area having a third defined number of prisms at least 1.5 times as great as the second defined number of prisms whereby the first concentric prismatic area further defines a radius, the second concentric prismatic area defines a second radius at least 1.5 times as great as the first concentric prismatic radius, and the third concentric prismatic area defines a third radius at least 1.5 times as great as the second concentric prismatic radius.

5 Claims, 5 Drawing Sheets

LUMINAIRE LENS ASSEMBLY

TECHNICAL FIELD

This invention relates to a luminaire lens assembly which is particularly suited for indoor applications such as retail store, restaurant and warehouse illumination as well as general industrial applications.

BACKGROUND ART

Retail stores and restaurants require even, uniform, lighting which is adequate for operation while subtle enough not to create unwanted glare. Uniform lighting should illuminate all areas with a consistent dispersed light. The use of larger, more powerful lights is becoming more prevalent in large scale restaurants and retail stores where large open spaces must be illuminated. This must be achieved however without creating a "football" field effect or expressly over lighting any one area.

Warehouse facilities also require uniform lighting which is energy efficient yet capable of fully illuminating the appropriate areas for everyday operation. In large warehouses using forklift truck inventory movement, the forklift drivers must be able to read labels on the inventory from their seats. This makes good vertical and horizontal illumination especially important. In some facilities, the inventory is stacked three to four feet high on skids. The skids are then piled three high, which means drivers may be reading product labels as high as 15 feet off the floor.

As the commercial trend moves to larger retail and restaurant facilities which require lighting more similar to historical industrial lighting systems, a solution is needed which provides industrial style lighting modified for retail, restaurant and warehouse applications. A luminaire assembly in combination with an efficient lighting unit is needed.

An improved luminaire lens assembly should provide uniform lighting, minimum perceived glare to those working under the system and a reduction in any potentially dark areas below the system. The improved luminaire lens assembly should make use of refracting prismatic lenses in combination with adequate reflective lenses to create the desired illumination while achieving an aesthetically pleasing luminaire.

SUMMARY OF INVENTION

It is a principal object of the present invention to provide a luminaire lens assembly which produces uniform lighting with minimum glare by using a combination of reflective and refractive lenses.

It is a further object of the present invention to provide a luminaire lens assembly using equally spaced and equally sized prisms in luminaire lenses to allow the light passing through the prisms to illuminate without being significantly reduced in intensity or significantly lost by refraction.

It is still a further object of the present invention to provide a luminaire lens assembly using a bottom refractive lens having an internal refractive area which utilizes a stepped down system for arranging the refractive prismatic areas.

In carrying out the above objects, features and advantages of the present invention, the present invention provides a luminaire lens assembly with a top lens having an external reflecting area and a bottom lens including an external refracting area and an internal refracting area. The internal refracting area has at least three concentric prismatic areas. A first concentric prismatic area having a first defined number of prisms, a second concentric prismatic area disposed directly adjacent the first concentric area having a second defined number of prisms at least 1.5 times as great as the first defined number of prisms, and a third concentric prismatic area disposed directly adjacent the second concentric area having a third defined number of prisms at least 1.5 times as great as the second defined number of prisms. In addition the first concentric prismatic area defines a radius and the second concentric prismatic area defines a second radiuus at least 1.5 times as great as the first concentric prismatic radius. The third concentric prismatic area defines a third radius which is at least 1.5 times as great as the second concentric prismatic radius.

In the preferred embodiment, the number of prisms in the next adjacent concentric prismatic area is always twice as great as the number of prisms in the preceding concentric prismatic area and the radius of the next adjacent concentric prismatic area is always twice as great as the radius of the preceding concentric prismatic area.

It is yet another object of the present invention to provide a luminaire lens assembly having top lens with an annular portion including a first section and a second section where the first section is disposed adjacent the bottom lens and defined by a radius Rr1 and second section defined by a radius Rr2 where Rr2 is greater than Rr1 by a ratio in a range from 0.5 to 5.0.

It is still a further object of the present invention to provide a luminaire lens assembly having a top lens with an external reflecting area. The bottom lens includes an external refracting area and an internal refracting area. The internal refracting area has at least three concentric prismatic areas, a first concentric prismatic area having a first defined number of prisms, a second concentric prismatic area disposed directly adjacent the first concentric area having a second defined number of prisms at least 1.5 times as great as the first defined number of prisms, and a third concentric prismatic area disposed directly adjacent the second concentric area having a third defined number of prisms at least 1.5 times as great as the second defined number of prisms. The first concentric prismatic area also defines a radius. The second concentric prismatic area further defines a second radius which is at least 1.5 times as great as the first concentric prismatic radius. The third concentric prismatic area still further defines a third radius which is at least 1.5 times as great as the second concentric prismatic radius. The external refracting area includes a plurality of concentric prisms, each prism including a first prism wall and a second prism wall, whereby the first prism wall defines an angle A to the central axis Xc of the luminaire lens assembly and the second prism wall defines an angle B to the central axis Xc of the luminaire lens assembly and the relationship between angle A to x is $A=0.0114x^2-0.1071x+3.5158$ and the relationship between angle B to x is $B=-0.0012x^2-0.4468x+69.458$ and x is the prism number from the perimeter of the bottom lens.

The above objects and other objects, features and advantages of the present invention are readily apparent from the following detailed description of the best mode for carrying out the invention when taken in connection with the accompanying drawings.

BEST MODE FOR CARRYING OUT THE INVENTION

Figure 1:
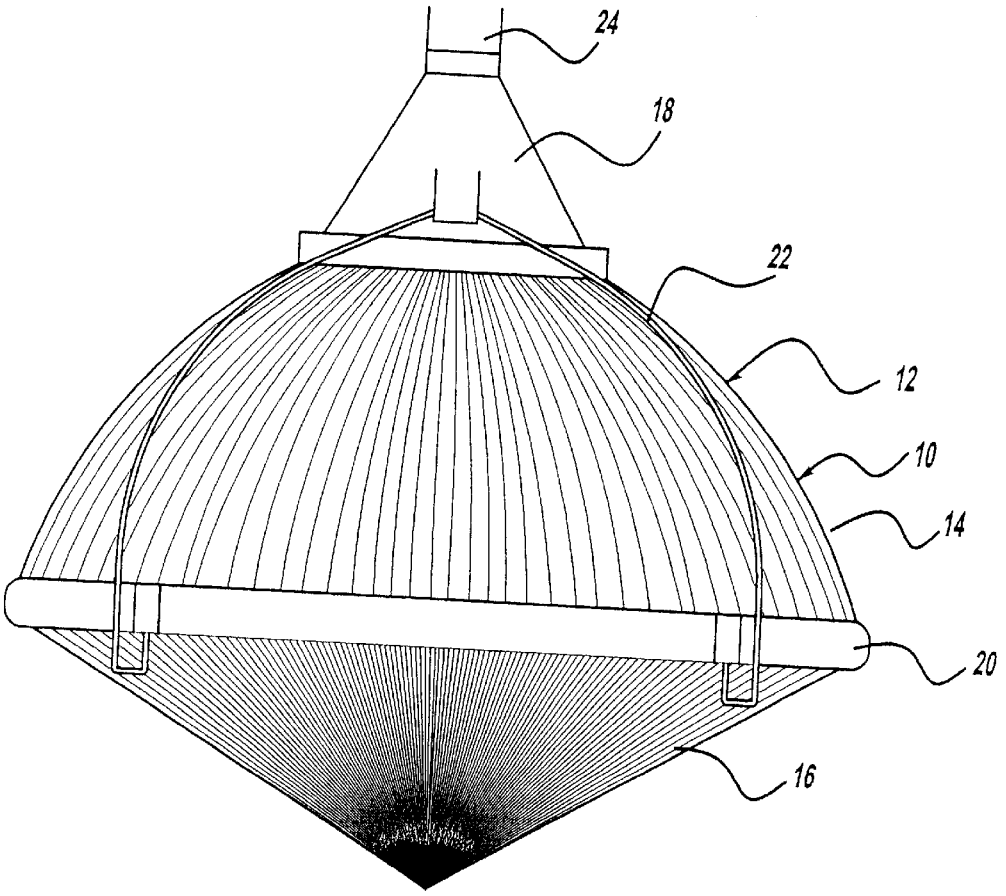
FIG. 1 is a perspective view of a luminaire lens assembly according to the present invention.

With reference to FIG. 1 of the drawings, shown therein is a luminaire 10 having a luminaire lens assembly 12 according to the present invention. In a preferred embodiment, and as illustrated in FIG. 1, luminaire lens assembly 12 includes a top lens 14 and a bottom lens 16. A cast aluminum husk 18 is mounted on the top lens 14. Latch 20 connects the top lens 14 and the bottom lens 16 through the use of steel wire latch bales 22 as is known in the art. The luminaire may be hung using any existing method, for example through the use of a stem 24.

Figure 3:
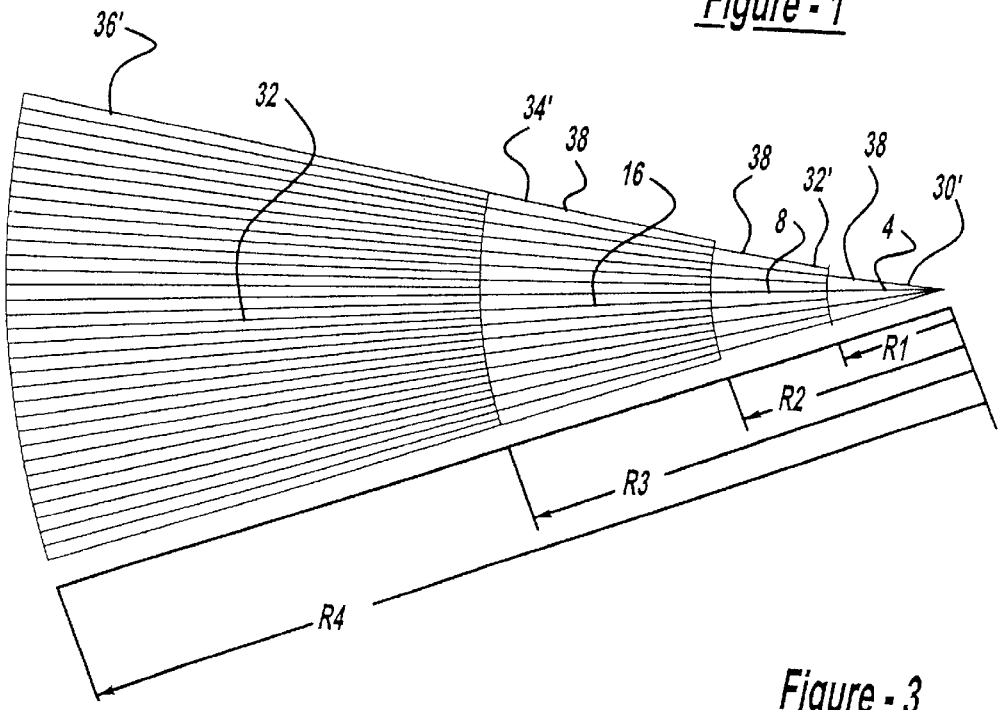
FIG. 3 is a partially segmented top view of the bottom lens of the luminaire of FIG. 2.
Figure 2:
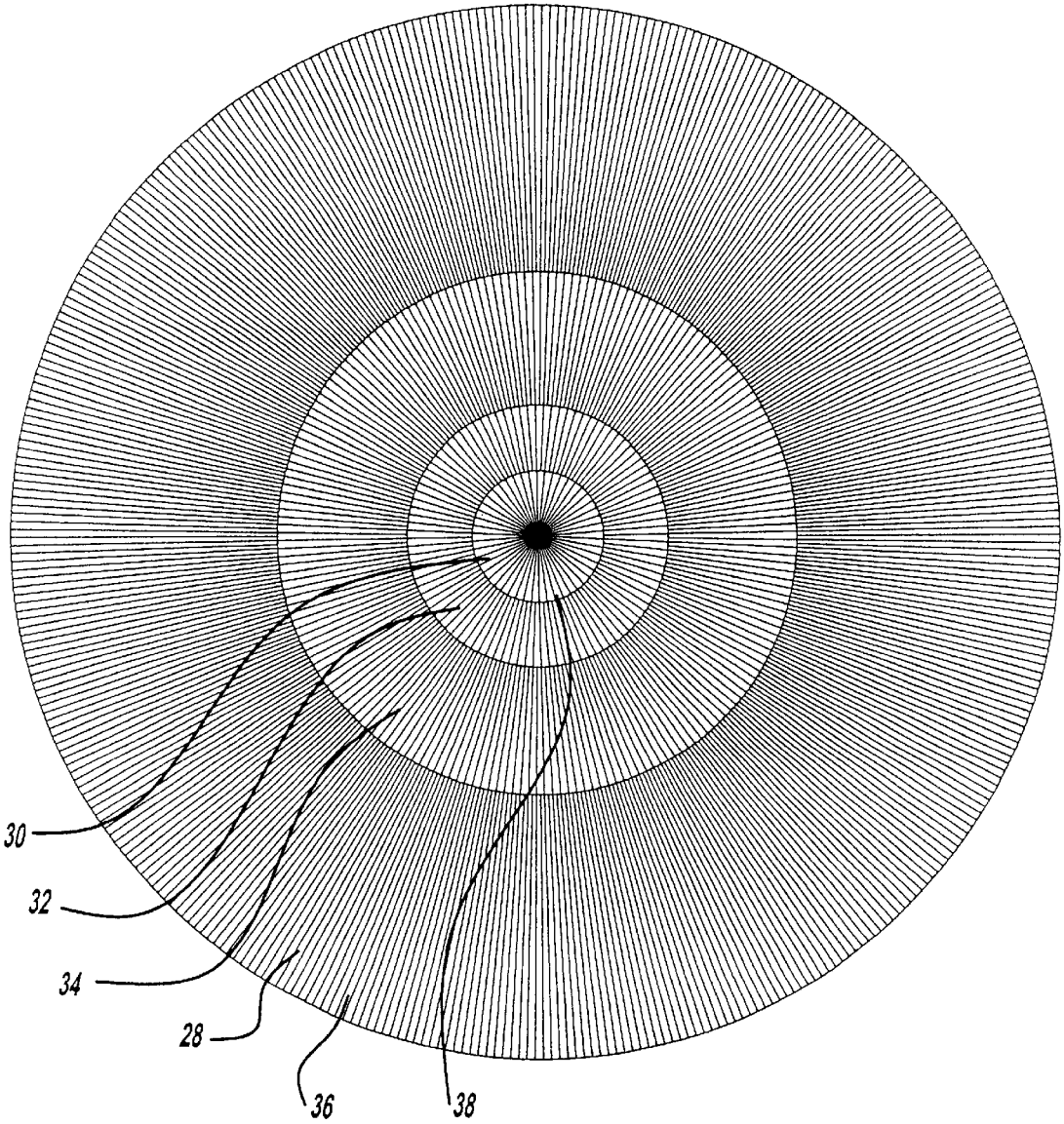
FIG. 2 is a top view of the bottom lens of the luminaire of the present invention.
Figure 5:
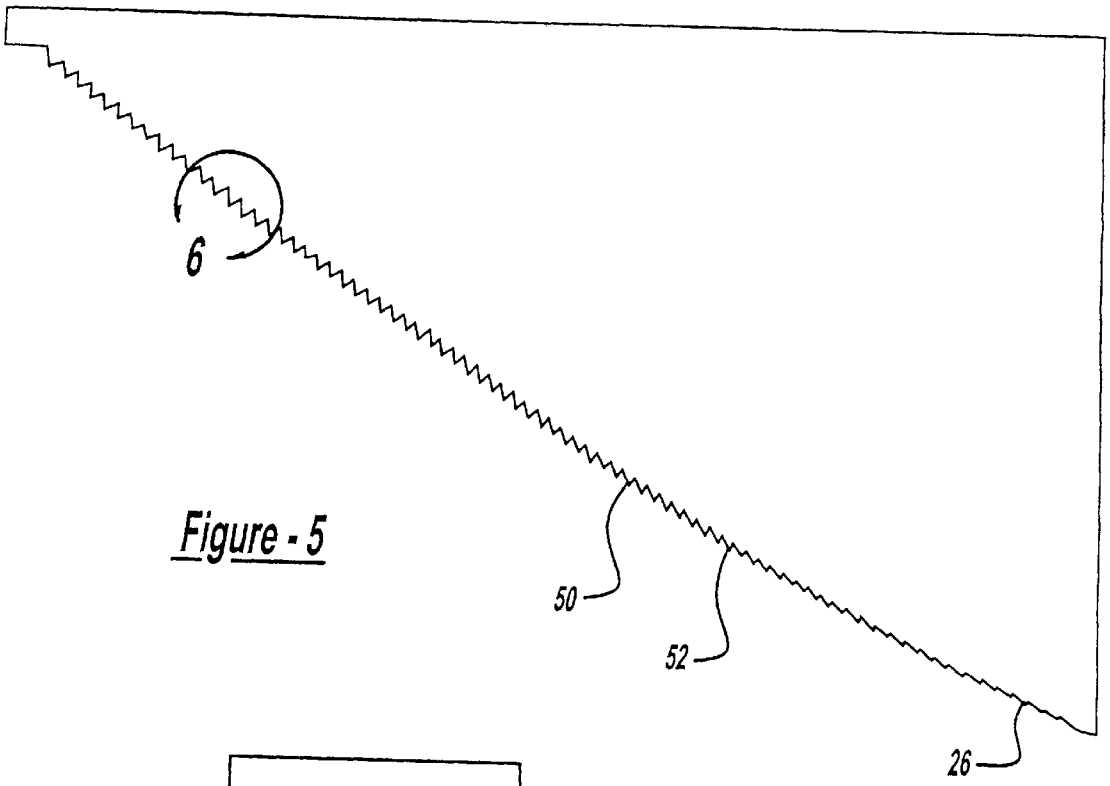
FIG. 5 a partial cross sectional view of the bottom lens of the present intention.

Bottom lens 16 may be manufactured from glass or clear acrylic plastic. The preferred embodiment uses borosilicate glass. The bottom lens 16 operates as a prismatic glass refractor and comprises an external refracting area 26 as shown in FIG. 5 and an internal refractive area 28 as illustrated in FIGS. 2 and 3. Referring now to FIGS. 2 and 3, there is shown internal refracting area 28. Internal refracting area 28 is shown in the embodiment illustrated in FIG. 2 as having four concentric prismatic areas. First concentric prismatic area 30 is centrally located on the bottom lens. Second concentric prismatic area is 32 is disposed concentrically about first concentric prismatic area 30. Third concentric prismatic area is 34 is disposed concentrically about second concentric prismatic area 32 and fourth concentric prismatic area 36 is disposed concentrically about third concentric prismatic area 34.

As is shown in FIGS. 2 and 3, first concentric prismatic area 30 has a defined number of prisms 38. In the preferred embodiment of the present invention, the second concentric prismatic area has exactly twice the number of prisms 38 as the first concentric prismatic area. For example, referring to FIG. 3, there is shown only a portion of internal refracting area 28. In the fractional portion 30' of first concentric prismatic area, there is shown four prisms 38. In the fractional portion 32' of second concentric prismatic area, there is shown eight prisms 38. In the fractional portion 34' of third concentric prismatic area, there is shown sixteen prisms 38 and finally in the fractional portion 36' of fourth concentric prismatic area, there is shown thirty-two prisms 38. The prisms 38 are of the fluted type. They are manufactured into the glass using a mold that was prepared using a circular cutter.

This uniform, stepped down arrangement of prisms 38 provides advantages by producing a uniform dispersal of light through the internal refractive area 28. The present invention contemplates a relationship of the number of prisms between adjacent concentric prismatic areas of at least 1.5 times as great moving from the inner most concentric prismatic area to the next adjacent concentric prismatic area. More precisely, in different embodiments of the present invention, the second concentric prismatic area should have at least 1.5 times the number of prisms 38 as the first concentric prismatic area. The third concentric prismatic area should have at least 1.5 times the number of prisms 38 as the second concentric prismatic area and the fourth concentric prismatic area should have at least 1.5 times the number of prisms 38 as the third concentric prismatic area.

Still referring for FIG. 3, the present invention also contemplates a uniformity in radial dimension when arranging the concentric prismatic areas in relation to each other. First concentric prismatic area 30 has a defined radius R1. In the preferred embodiment of the present invention, the second concentric prismatic area has a defined radius R2 which is exactly twice as large as R1. The third concentric prismatic area has a defined radius R3 which is exactly twice as large as R2 and similarly the fourth concentric prismatic area has a defined radius R4 which is exactly twice as large as R3.

Additionally this uniform relationship of radial distances provides advantages by producing a uniform dispersal of light through the internal refractive area 28. The present invention contemplates a relationship in the radial distances between adjacent concentric prismatic areas of at least 1.5 times as great moving from the inner most area to the next adjacent area. More precisely, in different embodiments of the present invention, the second concentric prismatic radius should be at least 1.5 times as great as the radius of the first concentric prismatic radius. The third concentric prismatic radius should be at least 1.5 times as great as the second concentric prismatic radius and the fourth concentric prismatic radius should be at least 1.5 times as great as the third concentric prismatic radius.

Figure 4:
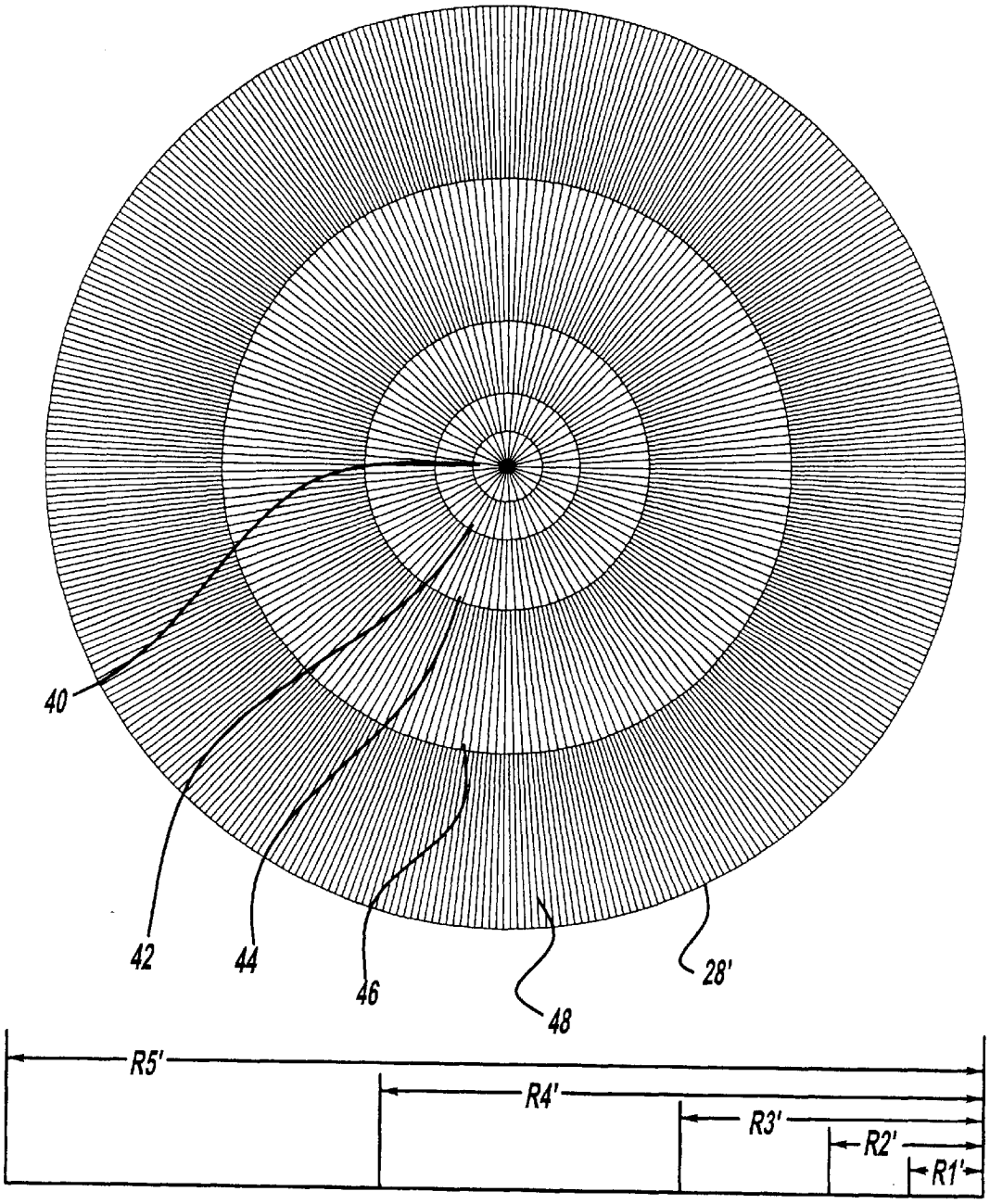
FIG. 4 is a top view of the bottom lens of an alternative luminaire of the present invention.

Referring now to FIG. 4, there is shown an alternative embodiment of the present invention using an internal refractive area 28' having five concentric prismatic areas. As described above, this alternative embodiment have a first prismatic concentric area 40, a second concentric prismatic area 42, a third concentric prismatic area 44, a fourth concentric prismatic area 46 and a fifth concentric prismatic area 48. The general arrangement of both the prisms 38 and concentric prismatic radii are the same as described above. More specifically, as is shown in FIG. 4, first concentric prismatic area 40 has a defined number of prisms 38. In the preferred embodiment of the present invention, the second concentric prismatic area 42 has exactly twice the number of prisms 38 as the first concentric prismatic area. The third concentric prismatic area 44 has exactly twice the number of prisms 38 as the second concentric prismatic area 42. Fourth concentric prismatic area 46 has exactly twice the number of prisms 38 as the third concentric prismatic area 44 and similarly the fifth concentric prismatic area 48 has exactly twice the number of prisms 38 as the fourth concentric prismatic area 46.

As described above, the alternative embodiment of the present invention also contemplates a uniformity in radial dimension when arranging the concentric prismatic areas in relation to each other. First concentric prismatic area 40 has a defined radius R1'. In this alternative embodiment of the present invention, the second concentric prismatic area 42 has a defined radius R2' which is exactly twice as large as R1'. The third concentric prismatic area 44 has a defined radius R3' which is exactly twice as large as R2", the fourth concentric prismatic area 46 has a defined radius R4' which is exactly twice as large as R3' and finally the fifth concentric prismatic area 48 has a defined radius R5' which is exactly twice as large as R4'. The present invention contemplates having at least three concentric prismatic areas.

Figure 6:
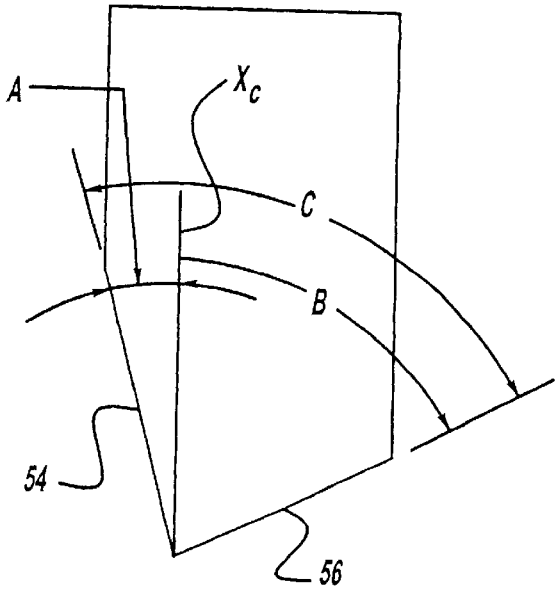
FIG. 6 illustrates the angles defined by the individual prisms disposed on the bottom lens of the present invention.

Referring now to FIG. 5, attention is turned to the external refracting area 50. External refracting area 50 utilizes triangular refractive types of prisms. The external refracting area 50 has flute type prisms 52 disposed in an improved arrangement according to the present invention. Each prism 52, disposed on the external refracting area 50, includes a first prism wall 54 as shown in FIGS. 6 and a second prism wall 56. First prism wall 54 defines an angle A to the central axis Xc of luminaire lens assembly 12. Second prism wall 56 defines an angle B to the central axis Xc of the luminaire lens assembly. The relationship between angle A to x is $A=0.0114x^2-01071x+3.5158$ and the relationship between angle B to x is $B=-0.0012x^2-0.4468x+69.458$ where x is the prism number from the perimeter of the bottom lens 16.

In this manner, any number of prisms 52 may be laid out along the external refracting area 50 while achieving the improved prism arrangement. This arrangement, as defined by the above noted formulas provides a very fine prismatic appearance with glare controllable lighting. In addition, this arrangement in combination with the stepped down and radial prism arrangements noted above provides a lighting solution with great uniformity and consistent dispersed light.

Figure 7:
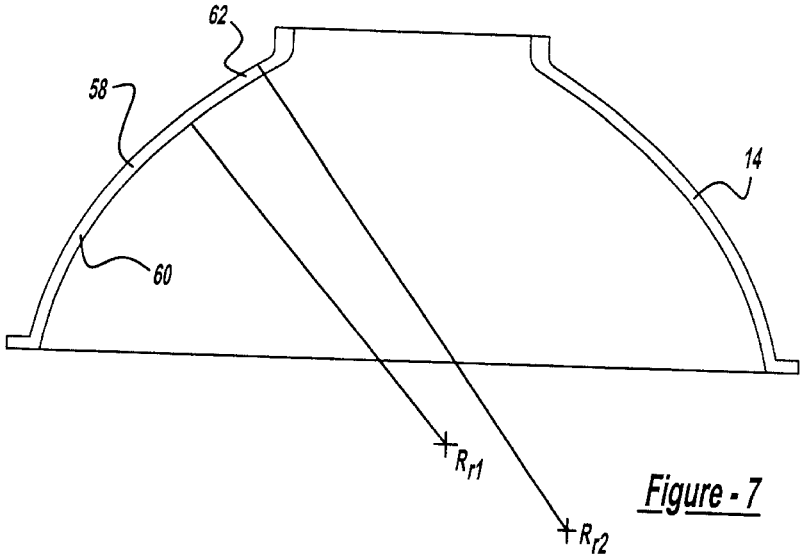
FIG. 7 is a cross sectional view of the top lens of the present invention.

Referring now to FIG. 7, there is shown the top lens 14 of the present invention. Top lens 14 may be manufactured from borosilicate glass or clear acrylic plastic. In the preferred embodiment the top lens 14 is manufactured from borosilicate glass. The top lens further has an annular portion 58. Annular portion 58 includes a first section 60 and a second section 62. First section 60 is disposed directly adjacent bottom lens 16. First section 60 is defined by a radius Rr1. Second section 62 is defined by a radius Rr2.

To provide the optimum lighting characteristics, according to the present invention, Rr2 must have a specific relationship to Rr1. Rr2 must be related to Rr1 by a multiplied ratio in a range from 0.5 to 5.0. In the preferred embodiment of the present invention, Rr2 will be greater than Rr1 by a ratio of approximately 2 to 4 and in the most preferred embodiment it will be 2.9 times greater. The top lens 14 of the present invention passes back down approximately 92% of the light emitted by the light source. The combined effect of the external reflecting area 26, internal refracting area 28 and external refracting area 50 is to provide a luminaire 10 which creates a desirable uniform lighting with minimum glare.

While the best mode for carrying out the invention has been described in detail, those familiar with the art to which this invention relates will recognize various alternative designs and embodiments for practicing the invention as defined by the following claims.

What is claimed is:

1. A luminaire lens assembly comprising:

a top lens having an external reflecting area; and a bottom lens including an internal refracting area having plurality of concentric prismatic areas, and an external refracting area, said external refracting area comprising a plurality of concentric prisms, each prism including a first prism wall and a second prism wall, whereby said first prism wall defines an angle A to the central axis Xc of said luminaire lens assembly and said second prism wall defines an angle B to the central axis Xc of said luminaire lens assembly and the relationship between angle A to x is $A=0.0114x^2-0.1071x+3.5158$ and the relationship between angle B to x is $B=-0.0012x^2-0.4468x+69.458$ and x is the prism number from the perimeter of the bottom lens.

2. The luminaire lens assembly of claim 1 wherein said internal refracting area comprises at least three concentric prismatic areas, a first concentric prismatic area having a first defined number of prisms, a second concentric prismatic area disposed directly adjacent said first concentric area having a second defined number of prisms at least 1.5 times as great as said first defined number of prisms, and a third concentric prismatic area disposed directly adjacent said second concentric area having a third defined number of prisms at least 1.5 times as great as said second defined number of prisms.

3. The luminaire lens assembly of claim 2 wherein said second defined number of prisms is at least twice as great as said first defined number of prisms and said third defined number of prisms is at least twice as great as said second defined number of prisms.

4. The luminaire lens assembly of claim 1 wherein whereby said first concentric prismatic area further defines a radius, said second concentric prismatic area defines a second radiuus at least 1.5 times as great as said first concentric prismatic radius, and said third concentric prismatic area defines a third radius at least 1.5 times as great as said second concentric prismatic radius.

5. The luminaire lens assembly of claim 6 wherein said second radius is at least twice as great as said first concentric prismatic area radius and said third radius is at least twice as great as said second radius.

* * * * *